US008136879B1

(12) United States Patent
Carlson et al.

(10) Patent No.: US 8,136,879 B1
(45) Date of Patent: Mar. 20, 2012

(54) ROWING MACHINE SEAT COVER HAVING A POCKET FOR HOLDING AN ELECTRICALLY POWERED PERSONAL DEVICE

(76) Inventors: John Lawrence Carlson, Weston, MA (US); Spencer Lane Almy, New York, NY (US); Michael James Guerrieri, Washington, DC (US)

( * ) Notice: Subject to any disclaimer, the term of this patent is extended or adjusted under 35 U.S.C. 154(b) by 107 days.

(21) Appl. No.: 12/658,893

(22) Filed: Feb. 17, 2010

Related U.S. Application Data

(60) Provisional application No. 61/208,118, filed on Feb. 20, 2009.

(51) Int. Cl.
*A47C 31/00* (2006.01)
*A47C 7/62* (2006.01)

(52) U.S. Cl. ..... 297/228.11; 297/219.11; 297/188.07

(58) Field of Classification Search ..... 297/219.12, 297/219.11, 228.11, 188.01, 218.4, 228.12, 297/188.07, 188.08, 223; 24/712
See application file for complete search history.

(56) References Cited

U.S. PATENT DOCUMENTS

| | | | | |
|---|---|---|---|---|
| 4,892,353 | A * | 1/1990 | Goddard | 297/224 |
| 5,333,921 | A * | 8/1994 | Dinsmoor, III | 297/219.1 |
| 5,557,815 | A * | 9/1996 | Mintz et al. | 5/636 |
| 5,716,096 | A * | 2/1998 | Pryde et al. | 297/228.11 |
| 5,894,639 | A * | 4/1999 | Boden et al. | 24/115 G |
| D484,351 | S | 12/2003 | Bridge | |
| 7,481,491 | B1 * | 1/2009 | Diamantis | 297/223 |
| 7,581,788 | B1 * | 9/2009 | Johnson | 297/229 |

* cited by examiner

*Primary Examiner* — Milton Nelson, Jr.
(74) *Attorney, Agent, or Firm* — George Lawrence Boller

(57) ABSTRACT

A seat cover for an rowing machine seat has a top for overlying the top of the seat and a skirt extending downward from, and running lengthwise along the length of the perimeter of the seat cover top. A cord that is spaced below the top piece runs along the length of the skirt and has a first end that protrudes from one of confronting lengthwise ends of the skirt and a second end that protrudes from the other of the confronting lengthwise ends of the skirt. The cord allows that skirt to be drawn around the seat for holding the seat cover in place on the seat. An open-top pocket hangs from the seat cover at a location along the perimeter of the seat other than the location at which the opposite lengthwise ends of the skirt are in confrontation. An electrically powered personal device, such as a battery-operated entertainment device, can be placed in the pocket for use by a user of the rowing machine.

5 Claims, 9 Drawing Sheets

ROWING MACHINE SEAT COVER HAVING A POCKET FOR HOLDING AN ELECTRICALLY POWERED PERSONAL DEVICE

REFERENCE TO RELATED APPLICATION AND PRIORITY CLAIM

This application claims the priority of Provisional Patent Application No. 61/208,118, filed on 20 Feb. 2009, the entire content of which is incorporated herein by reference.

FIELD OF THE INVENTION

This invention relates to rowing machines that are used for rowing training and/or exercise simulating rowing, and similar equipment in which a seat on which a user sits moves during use. Such rowing machines are sometimes called ergometers. More specifically, the invention relates to an article for conveniently holding an electrically powered personal device, such as a battery-operated entertainment device, for a seated user while he or she is using the machine or similar equipment.

BACKGROUND OF THE INVENTION

Some people use an entertainment device while exercising. When a person is walking or running, he or she can conveniently carry a small battery-operated device, such as a pocket radio or audio player, which can provide entertainment or useful information for the person through one or more speakers. The person may wear earplugs containing small speakers through which voice and/or music is delivered via wires connected to the device.

A rowing machine has a seat that slides back and forth on a track while a person is using the machine. If that person wishes to use a personal device, such as an audio entertainment device like a pocket radio or audio player, while using the machine, provision must be made for holding the device in a convenient manner. From personal experience with a rowing machine, the inventors consider it inconvenient for the user to carry the personal device. The nature of machines with which the inventors are familiar is also considered not well suited for holding the device.

SUMMARY OF THE INVENTION

The inventors have conceived and reduced to practice an article for conveniently holding a personal device that can be used by a person when seated on a seat that moves on a track when the person is using a machine such as an ergometer.

The article is a seat cover that comprises a top for overlying the top of the seat and a skirt extending downward from, and running lengthwise along the length of, the perimeter of the seat cover top. The skirt has opposite lengthwise ends that are in confrontation with each other at a location along the perimeter of the seat. A cord that is spaced below the top piece runs along the length of the skirt and has a first end that protrudes from one of the confronting lengthwise ends of the skirt and a second end that protrudes from the other of the confronting lengthwise ends of the skirt. The cord has an association with the skirt that allows that skirt to be drawn tight around the seat for holding the seat cover in place on the seat. An open-top pocket hangs from the seat cover at a location along the perimeter of the seat other than the location at which the opposite lengthwise ends of the skirt are in confrontation.

DETAILED DESCRIPTION

Figure 1:
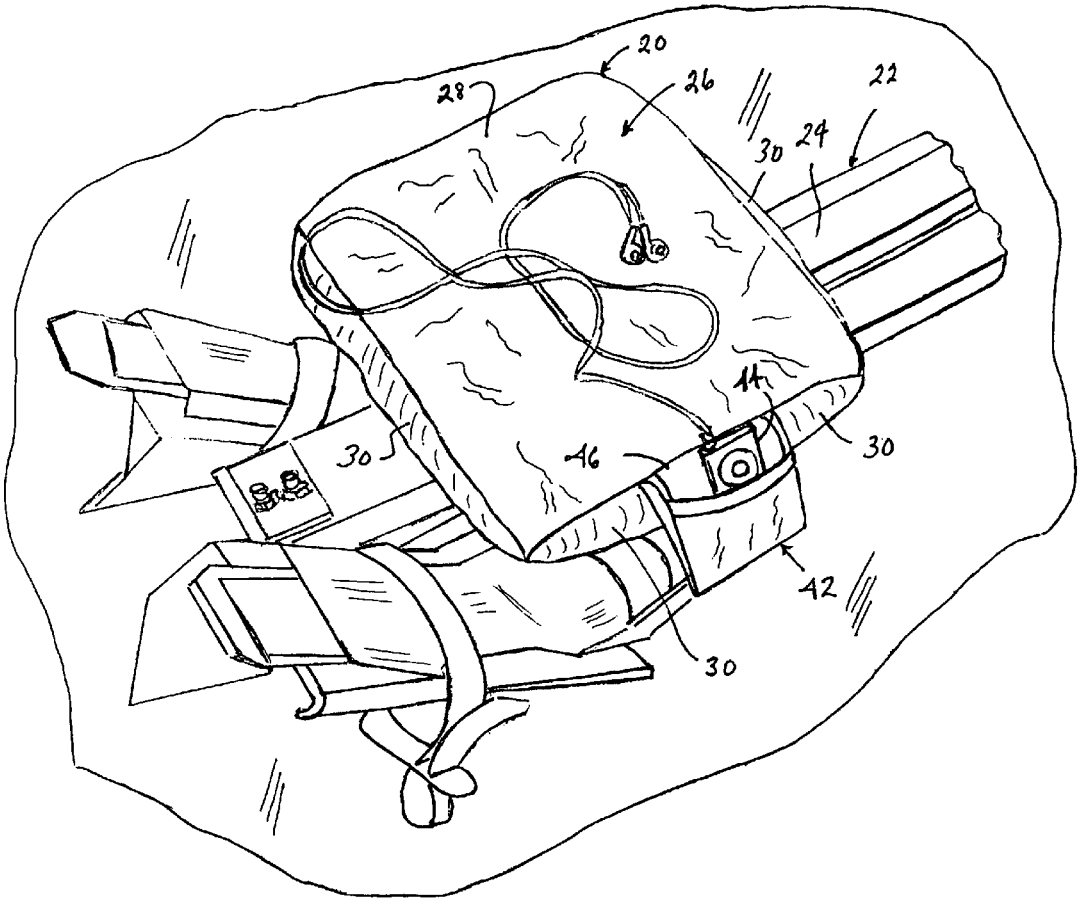
FIG. 1 is a perspective view of the article in place on a rowing machine seat looking generally downward at an angle from one side.

FIGS. 1-4 show various views of the article 20 in place on a generally rectangular seat of a rowing machine 22. The seat slides back and forth on a track 24. FIGS. 5-12 are views of article 20 by itself in various positions with portions of the article being folded or creased in some instances because of non-rigid materials that are used in the article.

Article 20 comprises a seat cover 26 that comprises pieces assembled together. One piece is a top piece 28 that has a generally rectangular shape for overlying the top of the generally rectangular seat of the machine. Top piece 28 comprises sheet material that can flex without elongating. Various materials are suitable for top piece 28, marine-grade vinyl being one example.

A second piece of seat cover 26 is a side piece, or skirt, 30. It too is sheet material that can flex without elongating, but it is a fabric, such as nylon, that can easily gather and ungather. Skirt 30 is initially a strip of material whose length is substantially equal to the length of the perimeter of top piece 28 or slightly longer. With one end of the strip placed substantially at the midpoint of one of the shorter sides of top piece 28, the top margin of the strip at that one end is turned inward and stitched to the inward-turned perimeter margin of top piece 28. From there the stitching is continued in one direction around the perimeter of the top piece to attach the entire top margin of the strip substantially to the entire perimeter of the top piece. This allows the skirt to hang down over the sides of the movable seat while leaving the lengthwise ends of the strip free except where they are stitched to the top piece. Because the margins that are stitched together are turned inward, they are not seen when seat cover 26 is in place so that the seam presents an appearance of one piece abutting the other.

The bottom margin of skirt 30 is turned inward back underneath itself to form a hem 32 that encloses a cord 34 running lengthwise through the interior of the hem while allowing opposite end segments of the cord to protrude from the free lengthwise ends of the skirt. Those end segments of the cord pass through a stop 36 that has a mechanism that grabs the cord end segments while allowing them to be drawn through in one direction but not the other. The stop mechanism also has a spring-loaded slide 38 that can be slid against the spring force to release the mechanism's grip on the cord so that the stop can be slid along the cord's end segments. The cord ends 40 that protrude from stop 36 opposite from where they enter the stop after coming out of hem 32 can be knotted by knots 41 to prevent the stop from coming off the cord.

Before or during the process of stitching the skirt piece to the top piece, a pocket 42 is associated with the skirt and top pieces. Pocket 42 is fabricated from material which can be material similar to that used for top piece 28. The pocket is generally rectangular in shape. The pocket interior is narrower than its width and depth, and it is open at the top, but otherwise closed. This particular shape is for snuggly holding a small device 44 of similar rectangular shape, a contemporary example of which is a commercial product known as the iPod, while allowing the device to be easily inserted into the interior of the pocket through the open top and later removed. An iPod can be seen in the pocket in FIGS. 2-6 and 8. (The device in FIG. 1 is a different and smaller device.) With device 44 fully inserted into pocket 42, the top portion of the device protrudes for convenient grasping and for making certain controls on the top face of the device readily accessible. Although not shown, the large outer sidewall of the pocket may have a through-hole that allows access to a control in the confronting side face of the device.

Figure 5:
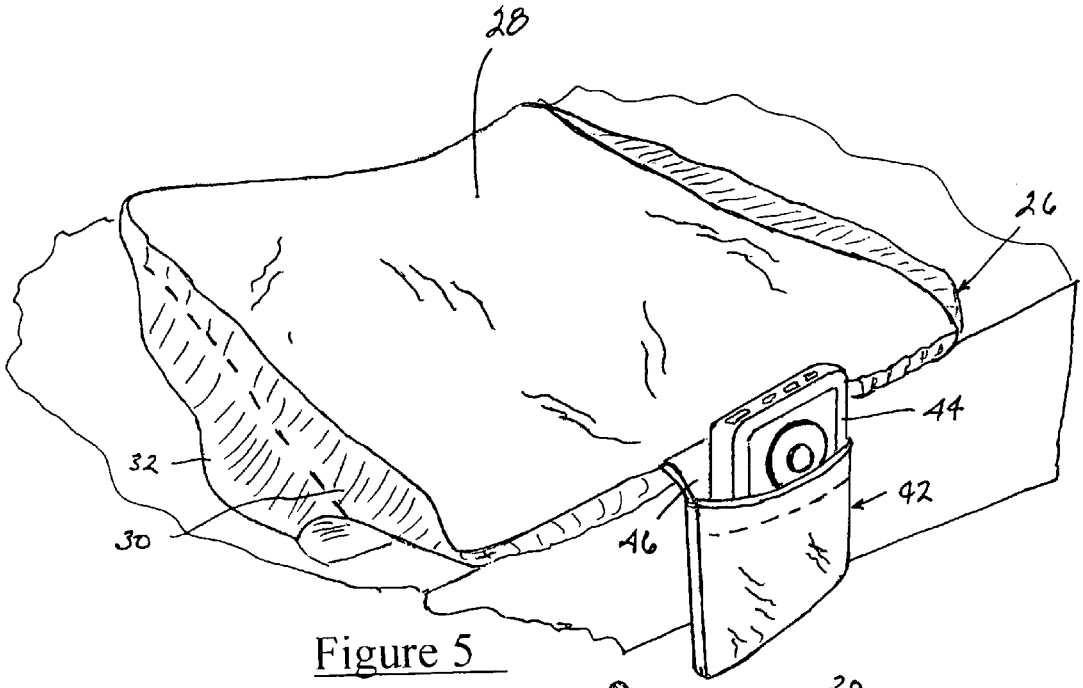
FIG. 5 is a larger perspective view of the article by itself after having been removed from the rowing machine seat and placed on a horizontal surface with a pocket of the article hanging downward over an edge of the horizontal surface.
Figure 7:
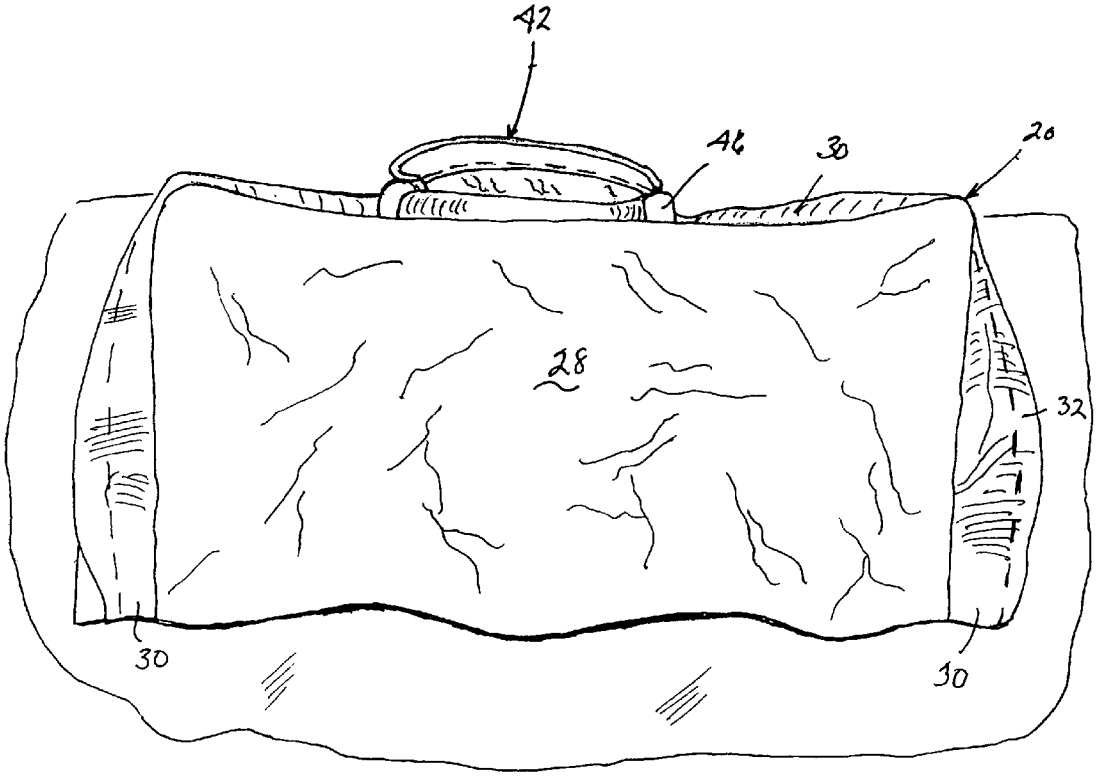
FIG. 7 is top view of a portion of the article with the pocket hanging downward.
Figure 8:
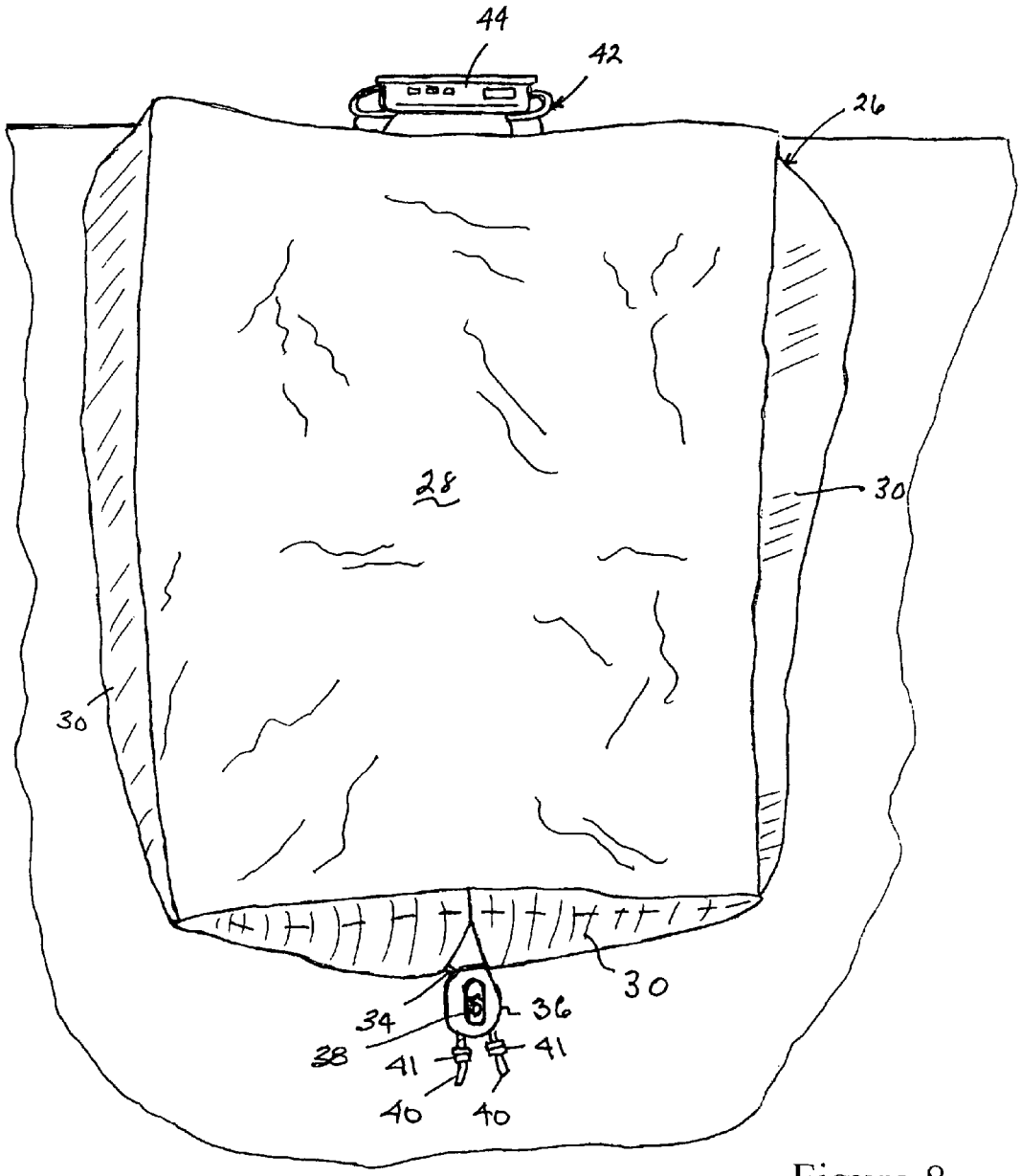
FIG. 8 is a top view of FIG. 5 looking downward.
Figure 9:
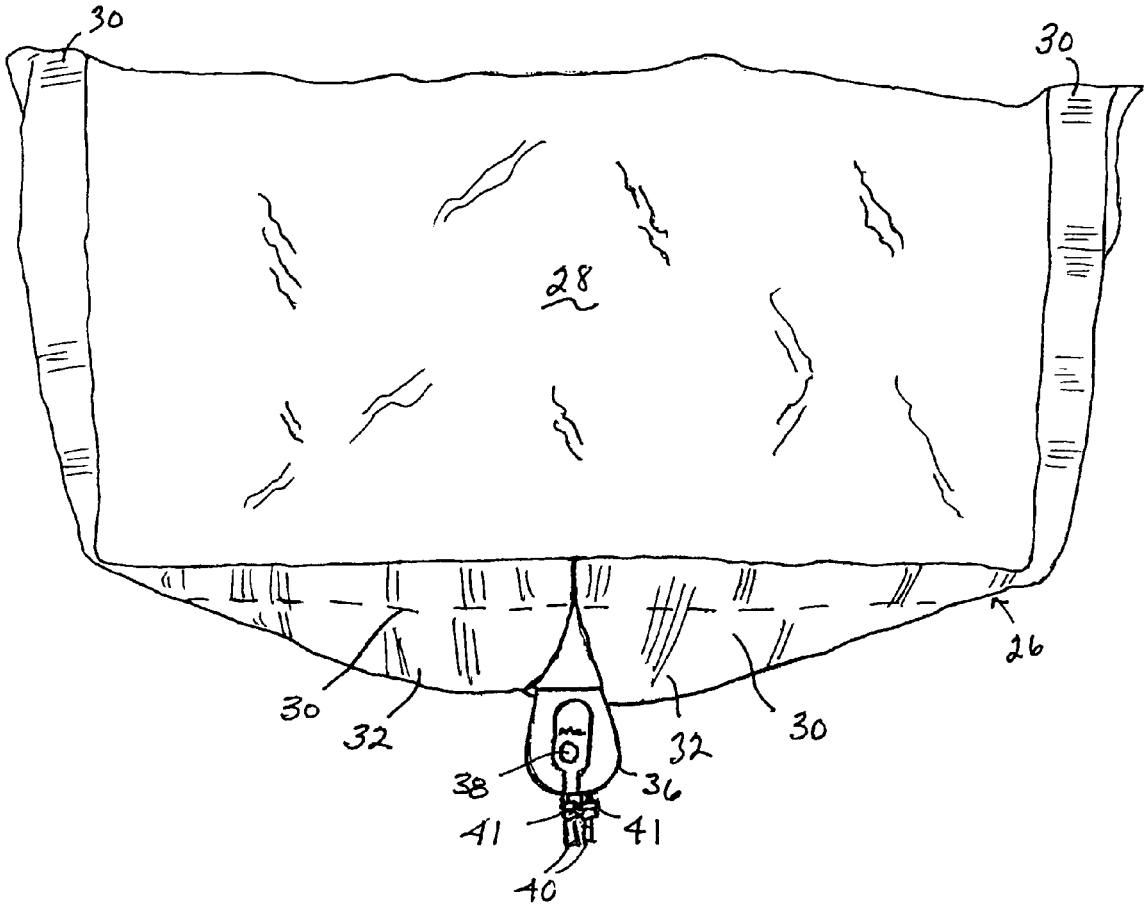
FIG. 9 is top view showing the portion of the article not seen in FIG. 7.

The pocket material has a flap 46 that provides for the pocket to be assembled to article 20 during stitching of skirt piece 30 and top piece 28. An end margin of flap 46 is placed between the perimeter margin of the top piece and the top margin of the strip that forms the skirt so that the stitching of the skirt to the top piece will also stitch the end margin of the flap to both pieces. The flap has sufficient length to allow that portion of the flap that is not held directly between the top piece and the skirt to protrude as seen in FIGS. 5 and 7 so that pocket 42 can freely hang over the side of the skirt when the device 44 is placed on the rowing machine seat.

Figure 3:
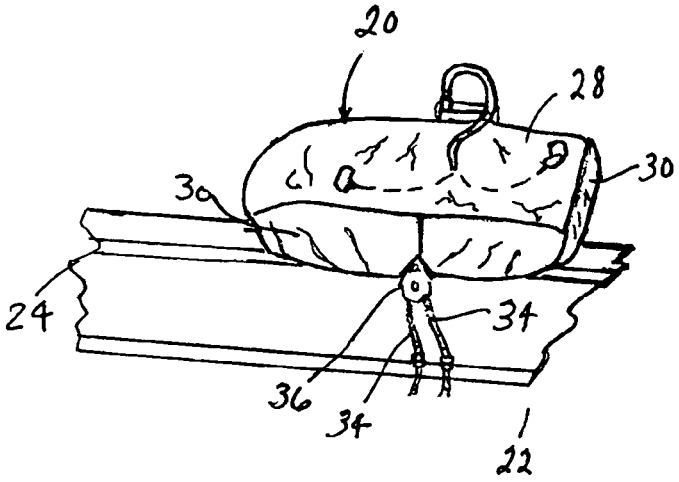
FIG. 3 is a view similar to FIG. 2 but from the opposite side.
Figure 2:
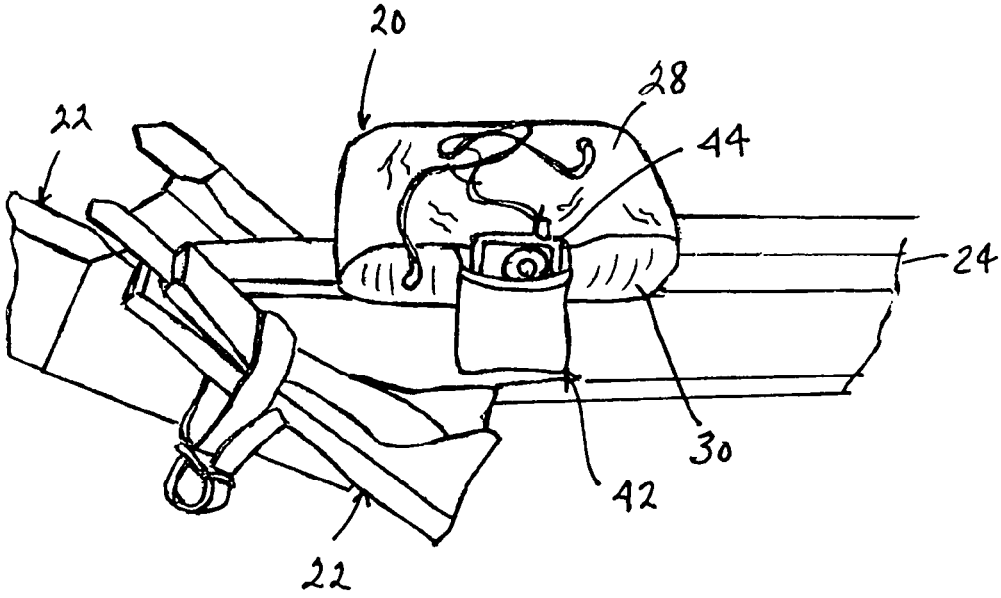
FIG. 2 is another view of the article from the same side, but on a smaller scale and in a slightly different direction.
Figure 4:
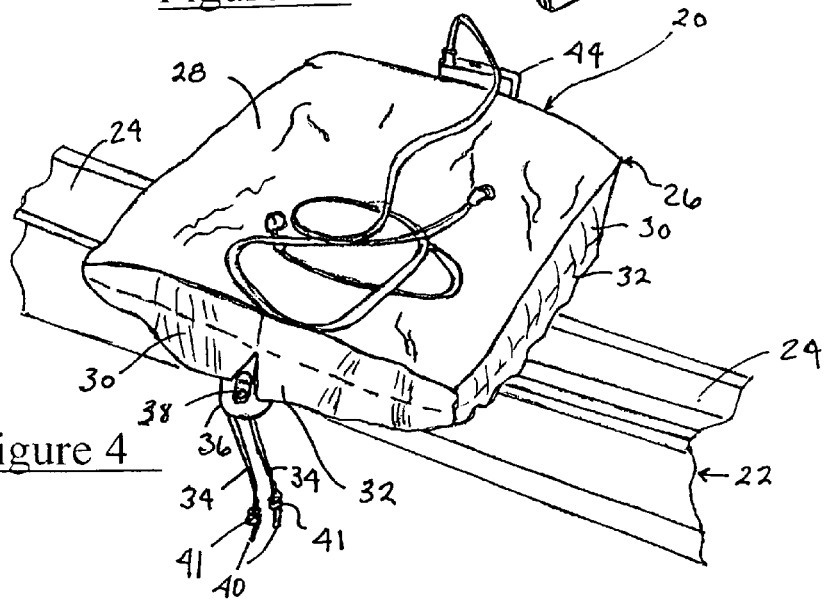
FIG. 4 is an enlarged view from the same side as FIG. 3 but with the rowing machine seat in a different position.
Figure 6:
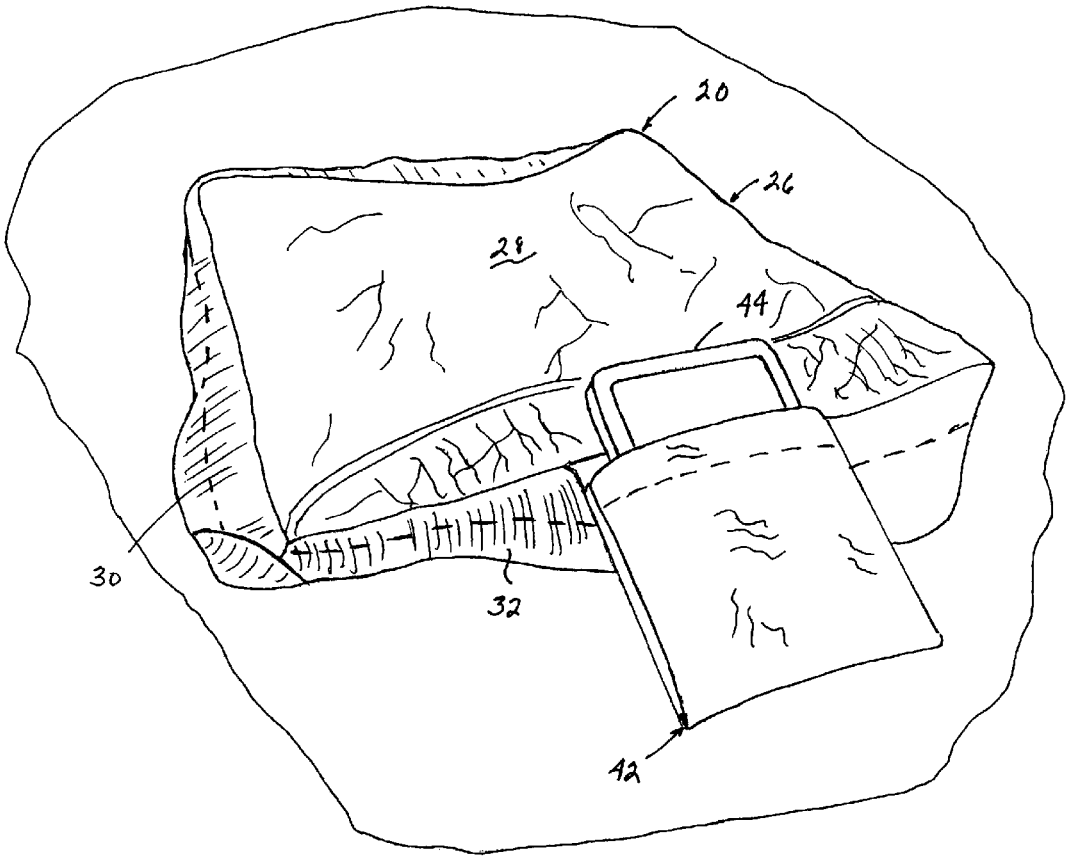
FIG. 6 is a view similar to FIG. 5 but with the entire article on the horizontal surface.
Figure 10:
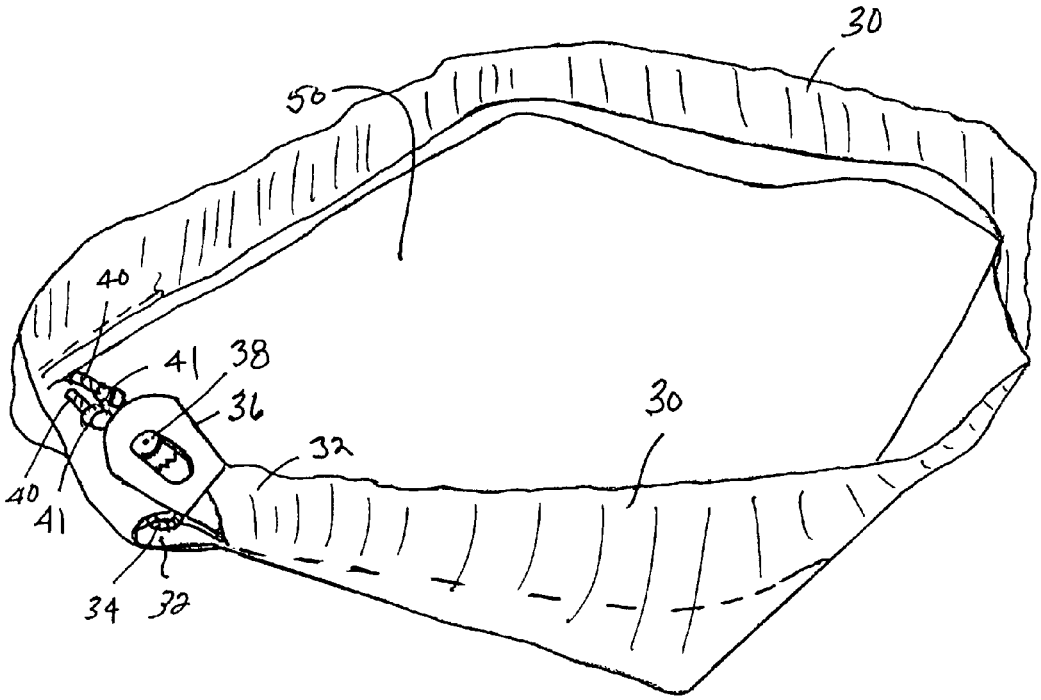
FIG. 10 is a perspective view with the article turned upside down from FIGS. 7-9.

The nature of the construction that has been so far described allows the article to be placed onto the seat by positioning stop 36 near the knots 41 (as in FIGS. 8 and 9) to allow the bottom margin of the skirt to form to a perimeter greater than the perimeter of the seat so that the article can be fit onto the seat with top piece 28 overlying the seat and the skirt hanging over the seat sides as shown in FIGS. 2, 3, and 4. (FIG. 10 shows article 20 upside down on a table so that the interior can be seen.) After the article has been placed on the seat, the knotted ends of the cord 34 can be pulled through stop 36 (because the stop mechanism allows the cord to be pulled only in this direction without having to operate slide 38 to release the mechanism's grip on the cord) to draw the bottom margin of the skirt (i.e. hem 32) into contraction below the sides of the seat. The fabric of the skirt gathers as this is done. The contracted length of the gathered skirt hem is maintained by stop 36 and that length is less than the perimeter of the seat to prevent the article from being removed.

Removal is made by first operating slide 38 to release the grip of stop 36 on the cord and then sliding the stop toward the knots 41 near the ends of the cord, allowing the effective length of the bottom margin of the skirt to increase by ungathering to a length that exceeds the length of the perimeter of the seat, thereby allowing the article to then be lifted off the seat.

Once removed from the seat, article 20 can be conveniently folded, usually after whatever device in pocket 42 has been removed to avoid the possibility of the device accidentally falling out of the pocket.

It is to be noticed that the location of stop 36 is opposite the location of pocket 42 so that neither interferes with the other. By placing the pocket at one side, earplug or headset wires can run from the device to a user's ears without interfering with the user's use of the machine, and the user can conveniently access controls on the device when necessary. The pocket location also is free of interference with the user's use of the machine.

Figure 11:
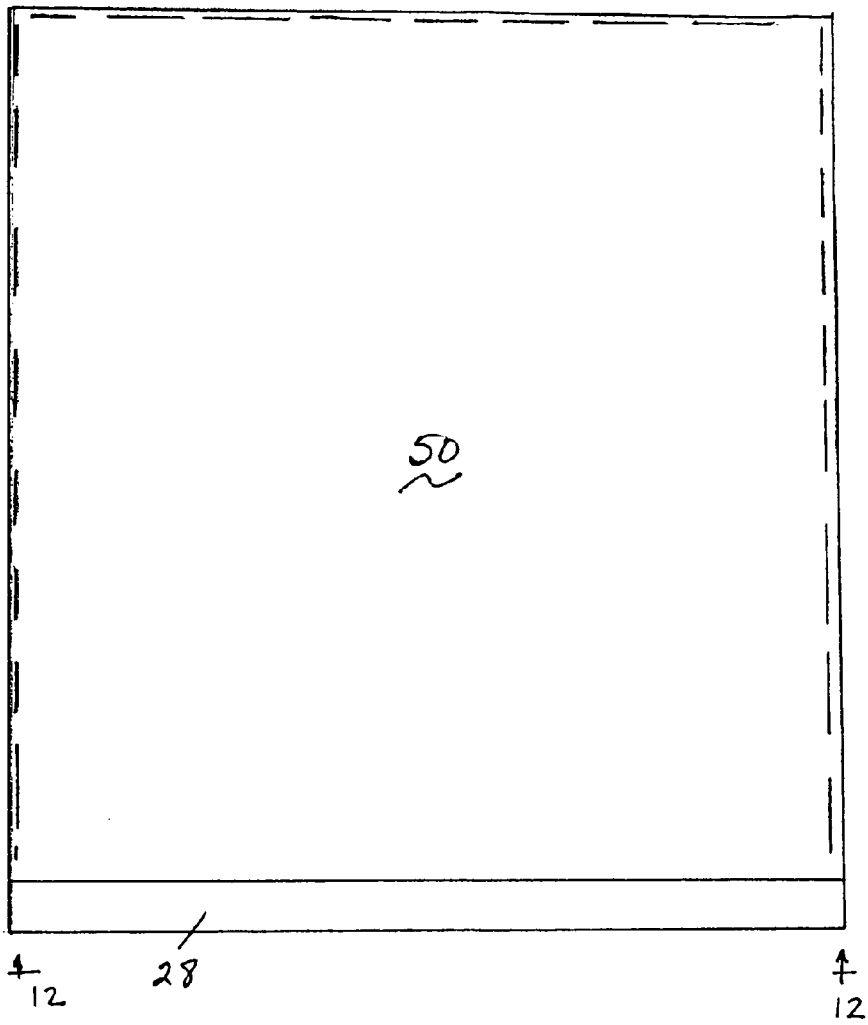
FIG. 11 is a plan view of the inside of the article.
Figure 12:
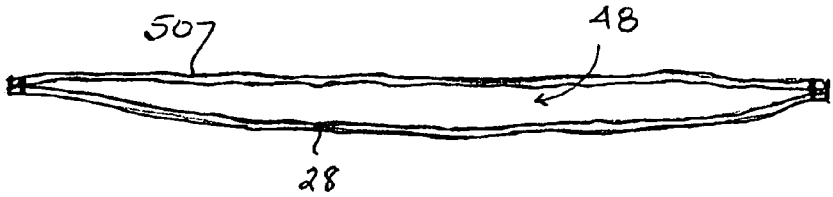
FIG. 12 is a view looking in the direction of arrows 12-12 in FIG. 11.

FIGS. 11 and 12 show that the interior of seat cover 26 has a pocket 48 into which a cushion (not shown) can be inserted. The pocket is formed by a generally rectangular piece 50 (also seen in FIG. 10) having a shape that allows it to be stitched in place directly beneath top piece 28 along three sides leaving the fourth side open so a cushion can be into and removed from it. The fourth side is open along the same side as stop 36 opposite the side at which flap 46 is inserted between top piece 28 and skirt 30. The length of piece 50 is slightly less than the length of top piece 28.

What is claimed is:

1. A seat cover comprising a seat cover top for overlying a top of a seat, the seat cover tip having a perimeter, a skirt extending downward from, and running lengthwise along the length of, the perimeter of the scat cover top, the skirt having opposite lengthwise ends that are in confrontation with each other at a location along the perimeter of the seat cover top, the skirt comprising a cord spaced below the seat cover top and running along the length of the skirt and having a first end that protrudes from one of the confronting lengthwise ends of the skirt and a second end that protrudes from the other of the confronting lengthwise ends of the skirt, the cord having an association with the skirt that allows the skirt to be drawn around the seat for holding the seat cover in place on the seat, and an open-top pocket hanging from the seat cover at a location along the perimeter of the seat cover top other than the location at which the opposite lengthwise ends of the skirt are in confrontation, in which the seat cover top has a rectangular shape, and the location along the perimeter of the seat cover top at which the open-top pocket hangs from the seat cover is along one of opposite sides of the rectangular-shaped seat cover top, and the location at which the opposite lengthwise ends of the skirt are in confrontation is along the other of the opposite sides of the rectangular-shaped seat cover top, the skirt comprises a hem through which the cord runs, the pocket has an interior that is narrower than both its width as measured along the length of the perimeter of the seat cover top and its depth as measured downward from the perimeter of the seat cover top, and the pocket comprises a flap having an end margin placed between a margin of the perimeter of the seat cover top and a top margin of the skirt, and further comprising stitching that stitches together the pocket flap, the margin of the perimeter of the seat cover top, and the top margin of the skirt.

2. A seat cover as set forth in claim 1 including a stop having a mechanism that grips end segments of the cord while allowing them to be drawn through the mechanism in one direction but not the other, and a release for releasing the grip of the mechanism on the end segments of the cord.

3. A seat cover as set forth in claim 1 in which the flap has sufficient length to allow a portion of the flap that is not placed between the margin of the perimeter of the seat cover top and the top margin of the skirt to protrude and enable the pocket to freely hang over the skirt.

4. A seat cover comprising a seat cover top for overlying a top of a seat, the seat cover top having a perimeter, a skirt extending downward from, and running lengthwise along the length of, the perimeter of the seat cover tip, the skirt having opposite lengthwise ends that are in confrontation with each other at a location along the perimeter of the seat cover top, the skirt comprising a cord spaced below the seat cover top and running along the length of the skirt and having a first end that protrudes from one of the confronting lengthwise ends of the skirt and a second end that protrudes from the other of the confronting lengthwise ends of the skirt, the cord having an association with the skirt that allows the skirt to be drawn around the seat for holding the seat cover in place on the seat and an open-top pocket hanging from the seat cover at a location along the perimeter of the seat cover top other than the location at which the opposite lengthwise ends of the skirt are in confrontation, and a pocket-forming piece that underlies, and cooperates with, the seat cover top to form a pocket having an opening through which a cushion can be inserted to underlie the seat cover top, in which the seat cover top has a rectangular shape, the pocket-forming piece has a rectangular shape having a perimeter margin, the perimeter margins of the pocket-forming piece and the seat cover top are stitched together along three sides of their respective rectangular shapes to form the opening through which a cushion can be inserted along a fourth side of their respective rectangular shapes.

5. A seat cover as set forth in claim 4 in which the location along the perimeter of the seat cover top at which the open-top pocket hangs from the seat cover is along a side opposite the fourth side and the location along the perimeter of the seat cover top at which the opposite lengthwise ends of the skirt are in confrontation is along the fourth side.

* * * * *